United States Patent [19]

Lewis, Jr.

[11] Patent Number: 4,772,073

[45] **Date of Patent: * Sep. 20, 1988**

[54] FILAMENT STOCK BOX

[75] Inventor: John C. Lewis, Jr., Salisbury, Vt.

[73] Assignee: Tucel Industries, Inc., Forest Dale, Vt.

[ * ] Notice: The portion of the term of this patent subsequent to Sep. 12, 2004 has been disclaimed.

[21] Appl. No.: 50,144

[22] Filed: May 15, 1987

Related U.S. Application Data

[62] Division of Ser. No. 825,870, Feb. 4, 1986, Pat. No. 4,693,519.

[51] Int. Cl.[4] ..... A46D 1/08

[52] U.S. Cl. ..... 300/21; 222/161; 222/564; 222/547

[58] Field of Search ..... 300/2-8, 300/21; 53/151; 425/508; 222/189, 1, 196, 200, 547, 161, 564; 131/44, 74

[56] References Cited

U.S. PATENT DOCUMENTS

| | | | |
|---|---|---|---|
| 1,587,418 | 6/1926 | Rojo y Reyes | 53/151 X |
| 2,239,589 | 4/1941 | Chalmers et al. | 53/151 |
| 4,255,224 | 3/1981 | Lorenz | 300/2 X |
| 4,310,377 | 1/1982 | Lorenz | 300/2 X |
| 4,399,931 | 8/1983 | Maddalena | 222/564 X |
| 4,489,534 | 12/1984 | Gömann et al. | 53/151 |
| 4,693,519 | 9/1987 | Lewis, Jr. | 222/564 X |

FOREIGN PATENT DOCUMENTS

| | | | |
|---|---|---|---|
| 698746 | 10/1940 | Fed. Rep. of Germany | 222/161 |
| 140444 | 3/1980 | German Democratic Rep. | 222/547 |

*Primary Examiner*—H. Grant Skaggs
*Assistant Examiner*—Nils E. Pedersen
*Attorney, Agent, or Firm*—Lowe, Price, LeBlanc, Becker & Shur

[57] ABSTRACT

A method for dispensing tufts of filaments from a filament stock box is described. The method includes providing a stock box for containing cut to length filament. The stock box has a front wall with at least one aperture in the lower portion thereof, a rear wall, side walls, and a base. When the box contains filament, the filament is oriented parallel to the planes containing the side wall, and the box defines a lower picking zone and an upper reservoir. The method includes providing a choke means for regulating the flow of filament from the reservoir into the picking zone so that the density of filament in the reservoir is greater than the density in the picking zone. The method also includes causing the rear wall in the lower portion thereof to vibrate against the adjacent filament ends while a tuft thereof is withdrawn through the aperture. The tufts so dispensed are then fused at an end and mounted on synthetic brush and broom blocks to form brushes or brooms or the like.

15 Claims, 6 Drawing Sheets

FILAMENT STOCK BOX

This application is a divisional of U.S. patent application Ser. No. 825,780, filed Feb. 4, 1986, now U.S. Pat. No. 4,693,519.

The need for improving filament stock boxes or magazines can be best illustrated by comparing and describing conventional filament stock boxes with the new and improved filament stock boxes of this invention.

The conventional staple-set brush picking operation (forming a filament tuft) employs a picker which can remove only one filament tuft at a time from a stock box or feed mechanism by first entering the stock box approximately at its midsection (lateral to the parallel filament) and picking a given amount of filament at the filament's midsection. Such filament stock boxes are disclosed in, for example, U.S. Pat. Nos. 2,433,191 (Baumgartner) and 3,059,972 (Schmidt).

The picker then proceeds to transport the predetermined volume of parallel filament to a suitable means for doubling the filament at its midsection, just prior to stapling, thus resulting in a tuft having a U-shape wherein both ends of the individual filament are located at the working end of the resultant tuft. A staple or anchor is then inserted through the U-shape loop and the tuft forced into a predrilled or molded hole in a brush-block. Each tuft is formed in this manner, one after another, until the necessary number of filament tufts stock box holds filaments having a length double of that of the finished tuft. Also, the conventional stock box merely holds parallel filament and depends upon the picking wheel for removing a given amount of filament therefrom. The conventional filament stock box then does not participate in forming: (1) tuft trim (2) tuft cross-section (3) tuft diameter, and can only contribute to the formation of one tuft at a time.

The filament stock box of this invention functions on an entirely different principle, and allows for exact control of filament flow through the box during the picking operation. Said boxes are capable of dispensing two, three or any number of predetermined filament tufts simultaneously, so that a brush or broom construction containing all its filament tufts can be fabricated instantly.

First, the filament employed for forming the tufts is half the length required for forming tufts in the conventional stapling manner. In my U.S. Pat. No. 3,471,202, U.S. Pat. No. Re. 27,455 and U.S. Pat. No. 3,563,609, the disclosures of which are hereby incorporated by reference, I describe tuft picking devices and tuft-forming means wherein brush and broom constructions containing tuft filaments are simultaneously picked and fabricated. The tuft picking devices described in the above mentioned inventions work in conjunction with the improved stock boxes of this invention. The picker or picking unit enters the filament stock box longitudinal to the filaments' end and engages the filament from one end; at this instant, the filament tuft is formed and trimmed.

Secondly, in order to effect this operation it is necessary to provide means within the filament stock box for filament alignment and retention during picking. Thirdly, it is necessary to provide means for retaining the unpicked filaments during tuft removal from the stock box and fourthly, means must be provided for allowing the reserve supply of filament contained in the filament stock box to be moved into position for subsequent picking. Unlike conventional stock boxes, the new and improved filament stock box of this invention plays an integral part during tufted brush construction and formation, namely that of cooperating with the picking unit.

In instances where the picking devices are comprised of many metal tubular means, the primary problem is indexing said metal means into an already filled stock box. This requires the picker to occupy the same space as the filament; in other words, the picker must push or move filament out-of-the-way in order to allow the filament in the stock box to either (1) enter the tubular opening, or (2) move outside of the opening and lay parallel to the tube length, without bending, crimping-over or distorting the filament. For this to take place, the necessary amount of filament must be present in the box opposite the openings in said box. During the energizing mode of indexing, howevr, when the picker moves forward into the box, there must be control-means or choking means present which will allow only the correct amount of filament flow into the picking zone.

Objects and advantages of the invention will be set forth in part hereinafter and in part will be obvious herefrom, or may be learned by practice with the invention, the same being realized and attained by means of the combinations, compositions, and improvements pointed out in the appended claims. The invention resides in the novel steps, methods, combinations, compositions and improvements herein shown and described.

While this invention is primarily concerned with new and novel filament control means located within filament stock boxes for dispensing synthetic cut-to-length filament for subsequent formation into tufted brush constructions, it should be realized that the principles of this invention are attained only through the novel combination of retaining cut-to-length parallel synthetic filament and dispensing those filaments in situations wherein (1) single filament tufts are formed, (2) multiple filament tufts are formed, (3) complete tufted brush-type constructions are simultaneously formed, and (4) continuous modular tufted strip-type brush constructions are formed.

Accordingly, it is an object of this invention to provide new and novel filament stock boxes for dispensing synthetic filament.

It is another object of this invention to provide a filament-dispensing stock box wherein the length of the synthetic filament employed is approximately that of the length of the resultant filament tuft formed.

It is a further object of this invention to provide a filament stock box having choke means located therein for controlling the flow of filament during the picking and energizing mode of tuft formation.

It is still another object of this invention to provide a filament stock box having integral means for alignment and retention of parallel filament during picking.

Further objects of this invention are to provide novel methods for the formation of synthetic filament tufts by employing the new and useful features of the types set forth in the foregoing objects, and will be obvious to those skilled in the art with reference to the drawings and following description wherein:

FIG. 1 is a rear view of an embodiment of the filament stock box of this invention with the rear wall and filament in the picking zone removed.

FIG. 1*a* is a side view of the filament stock box of FIG. 1 with a portion of the side wall removed.

FIG. 2 is a rear view of another embodiment of this invention with the rear wall and a portion of the filament removed.

FIG. 2*a* is a side view of the filament stock box of FIG. 2 with a portion of the side view removed taken along line A—A.

DEFINITIONS

The term "synthetic" filament as used hereinafter includes synthetic monofilaments which are formed from linear thermoplastic polymers from the group consisting of polystyrene and polystyrene copolymers, polyvinyl chloride and polyvinyl chloride-acetate copolymers, polyethylene, polypropylene, polyethylene-polypropylene copolymers, polyamides, polyesters and polyurethane. Both oriented and unoriented monofilaments may be employed. Also, various cross-sectionals shapes may be imparted to the monofilaments, such as for instance, i.e. circular, lobular, trifoil, X and Y cross sections, triangular, polygonal, star, etc. Mixtures of synthetic monofilaments may be employed in cases where the compositions of the monofilaments are compatible during any fusing operations, i.e. heat sealing. Such filaments may have suitable crimp imparted to their length or a portion thereof.

The term "picking" as used in the specification refers to the formation of filament tufts wherein two or more tufts are formed simultaneously by longitudinally engaging more than one cut-to-length filament at its end and removing from a parallel disposed bundle of filaments. The picking devices employed are those types which are disclosed in the aforementioned U.S. Pat. No. 3,471,202.

The term "apertures" as used in the specification refers to an opening in the face of the stock box, said opening allowing entrance of the picker into the filament contained therein. The aperture(s) correspond(s) in cross section to the cross section of the pickers.

The term "choke" means as used in the specification refers to means actually located within the filament stock box which controls the flow of filament from the large filling reservoir to the picking zone where the apertures are located. Choke means may be stationary and/or adjustable, depending upon the versatility and use of the stock box for more than one kind of filament.

The term "filament void" refers to an area directly under the choke means wherein the filament level fluctuates during the picking operation. It is contemplated that filament which passes through the choke means will rise to occupy the void during the energizing (vibration) phase of the picking operation.

The term "energizing" or (vibration) refers to the process of imparting energy to the non-working end of the filament during the indexing of the picker means into the filament stock box in order to fill the picker means with filament.

Figure 1A:
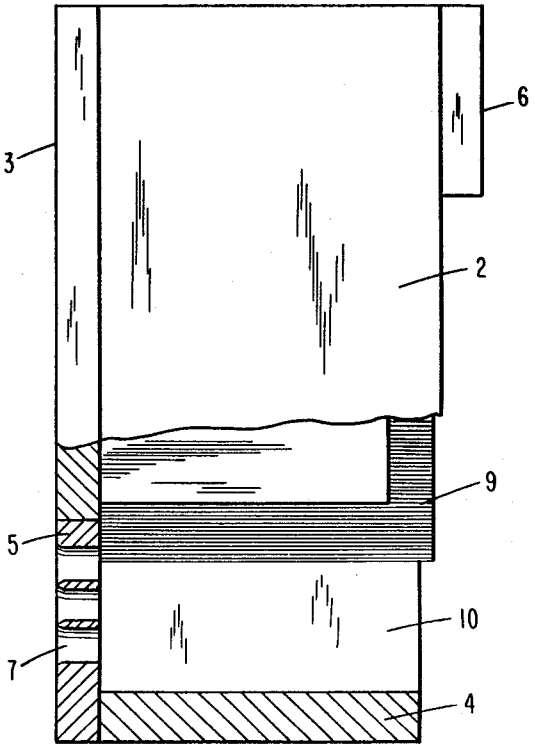
Figure 1:
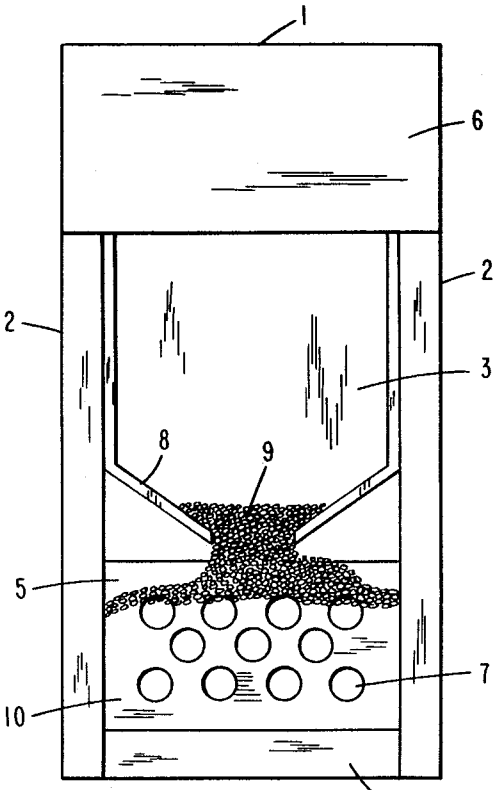

The filament stock box illustrated in FIG. 1 comprises a frame 1 having two sides 2, a bottom 4 and a back 6. The front 3 is attached above an aperture plate 5. There are a predetermined number of apertures 7 located in said aperture plate 5 corresponding to a tuft design. Choke means 8 is located within the frame 1 between the two sides and above the apertures 7 in order to retain parallel filament 9 in the same attitude as the sides of the frame and thus release or meter said filament 9 downward into the aperture 7 or picking zone 10 for subsequent picking.

Figure 2A:
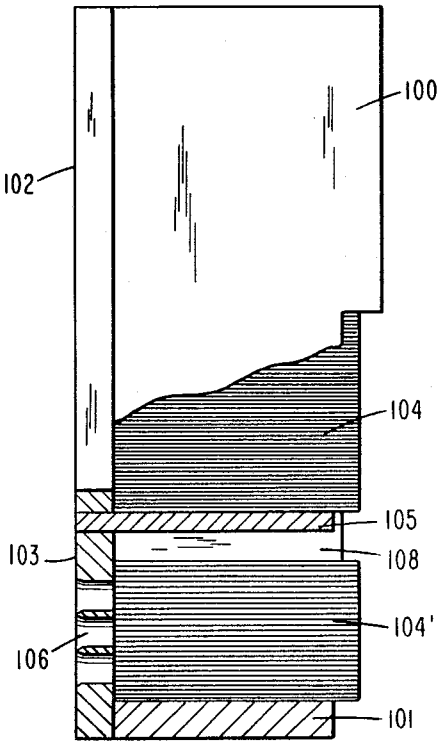
Figure 2:
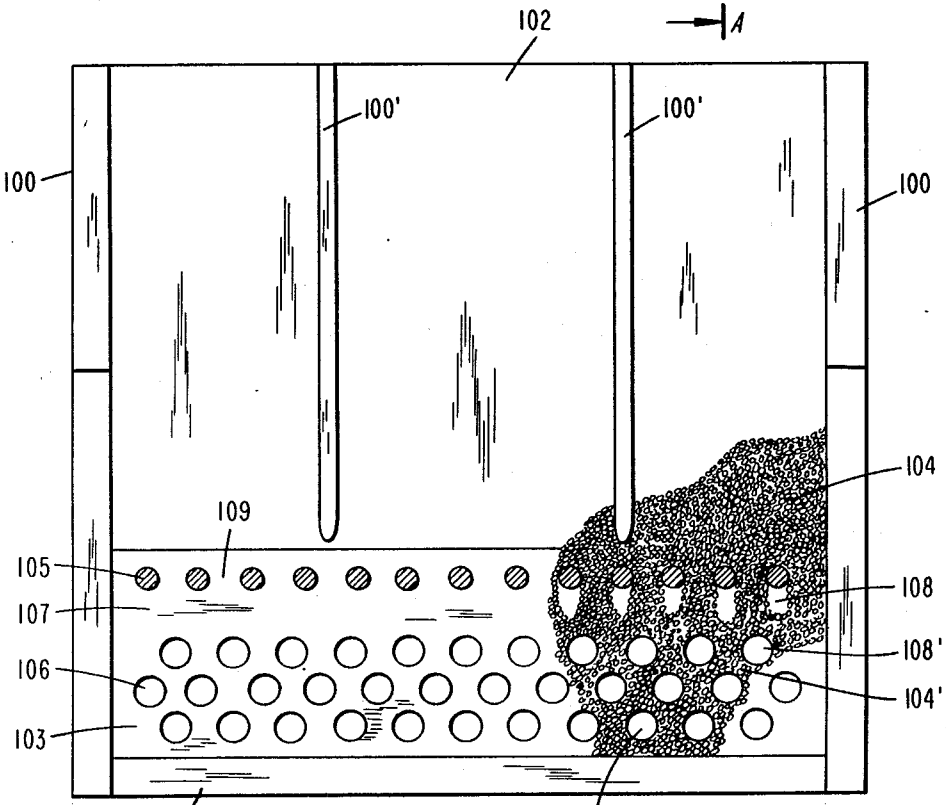

The filament stock box illustrated in FIG. 2 comprises a frame with sides 100, bottom 101 and front sections 102 and 103 in which the filament 104 is retained therein between the sides 100 and inside retaining means 100'. The front section 103 is comprised of a plate with apertures 106 for the picking element to enter through choke means 105 is provided to allow the filament 104 to flow therethrough.

In order to fully illustrate the embodiment of this instant invention it is necessary to describe the different stages of operation, namely the picking operation relating to tuft formation. Referring now to FIGS. 2–7, by reference characters, the stock box which is made up of pieces 100, 100', 101, 102 and 103 are supported on a support means. Cut-to-length filament 104 is contained therein and in general, fills the entire inside portion of the stock box. However, the filament supported above choke means 105 is more dense since it is compacted by the weight of the filament itself. The choke means 105 has an opening 109 a given distance, and this distance controls the flow of filament 104 therethrough. And as the filament 104 flows through the opening 109 it is separated from itself and falls loosely downward to the section of the stock box where the picking apertures 106 are located. As seen in FIG. 2*a*, the filament 104 above choke means 105 is very dense while there is actually some open space 108 directly below choke means 105 where there is a filament void, and the filament 104' below is less dense.

Figure 3:
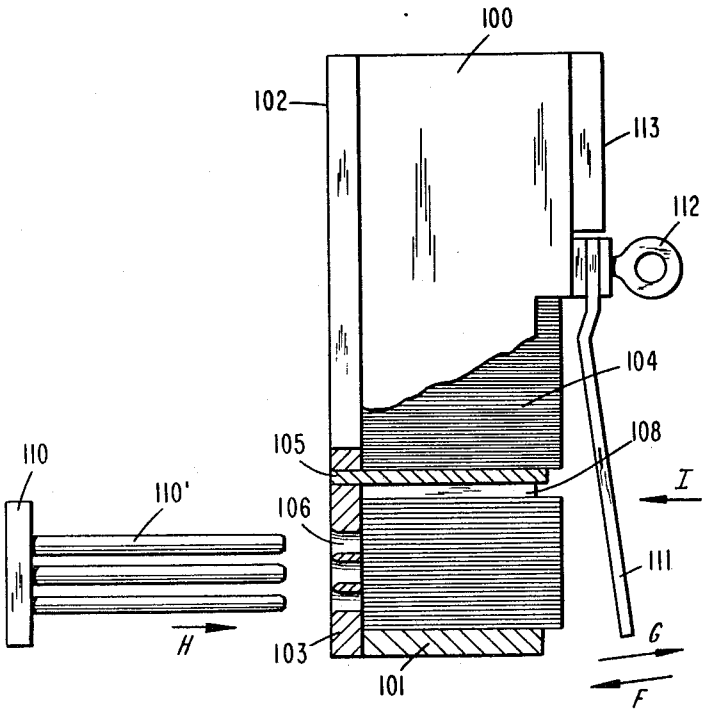
FIG. 3 is a side view of the filament stock box of FIG. 2*a* prior to indexing.

The sequence of picking is best described by illustration in FIG. 3. The picking element 110 containing pickers 110' is indexed forward in direction H, simultaneously, as energy as imparted in direction I by flapper plate 111, held on frame means by screw 112 directly under the back portion of frame 113. As the flapper plate is indexed back-and-forth in directions F and G, the filament 104, held in place by chokes 105 starts to move through and downward towards the apertures 106 in front face plate 103, filling up the area directly under the choke.

Figure 4:
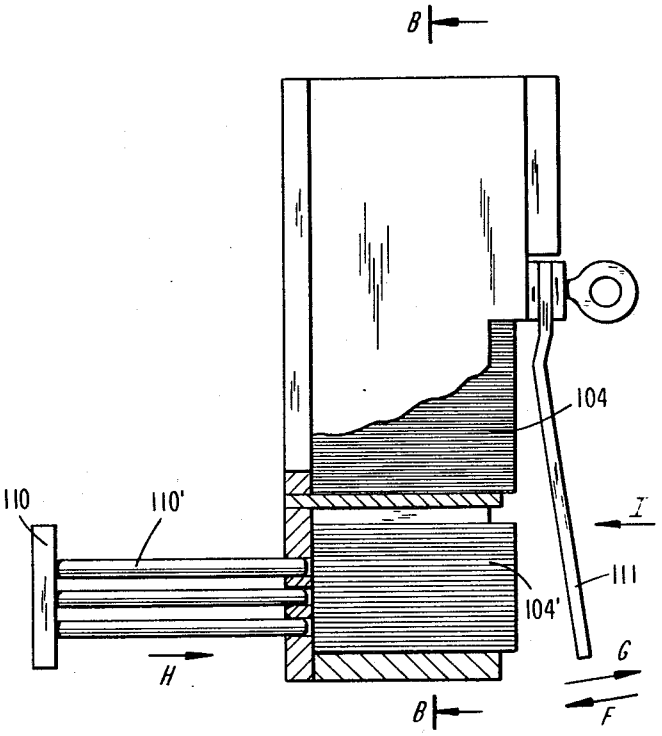
FIG. 4 is a side view of the filament stock box of FIG. 3 picking element during energizing.

Simultaneously, as shown in FIG. 4, the pickers 110' on picker element 110 enter the apertures 106 and pass therethrough during the energizing mode which in turn allows the pickers 110' to engage the filament 104' and fill each picker tube 110'. When the picker tub 110' enters the same space as the filament 104', there is room for both picker tube and filament 104' because the filament 104' is only lightly packed into the area behind the apertures 106.

Figure 6:
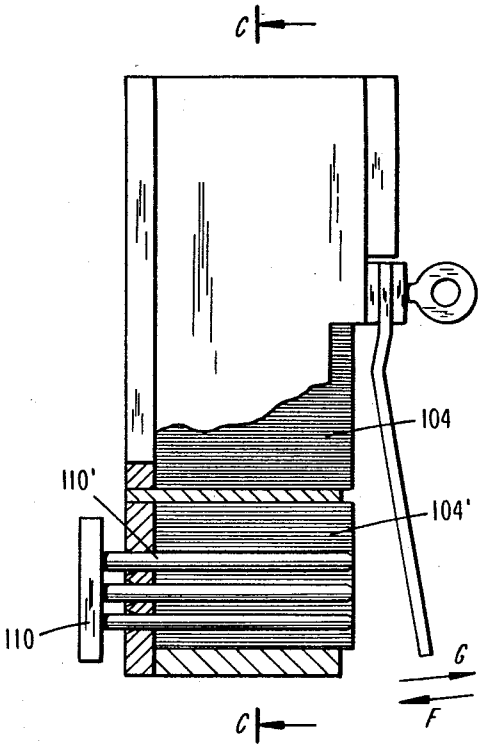
FIG. 6 is a side view similar to FIGS. 3 and 4 of the filament stock box and picking element after energizing prior to withdrawal from box.
Figure 5:
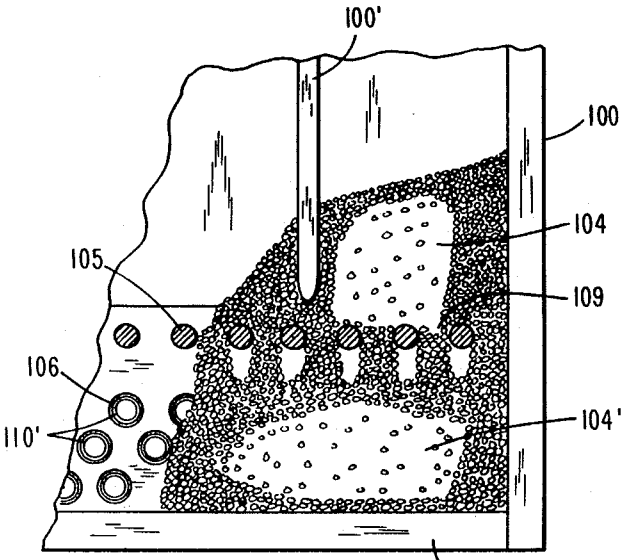
FIG. 5 is a fragmentary cross sectional view of the stock box of FIG. 4 as taken along line B—B.
Figure 7:
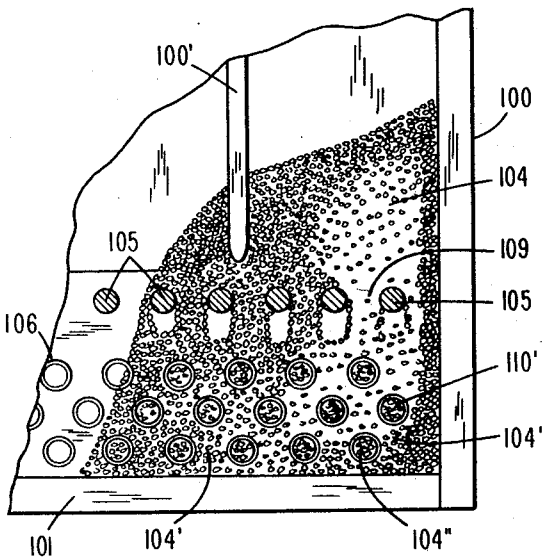
FIG. 7 is a fragmentary side view of the stock box of FIG. 6 with a portion of the side wall removed taken along line C—C.

FIGS. 6 and 7 further illustrate indexing of the picker element 110 into the stock box. Energizing or vibration then ceases for a moment. The picker element 110 with each individual picker tube 110' is now filled with filament 104''. Excess filament 104' has filled void 108 and the filament 104 located with the stock box and the filament 104' located outside of and around the picking tubes 110' are similarly tightly packed.

As the picking element 110 is withdrawn from the stock box, the filament remaining therein seeks the attitude illustrated in FIG. 2. There is a slight void 108 created under each choke member 105, and a very light density opening 108' at each position where the picker 110' had previously been located, thus leaving approximately the amount of filament 104' under the chokes 105 equal to the difference between the volume than can actually be allowed into the area 107 less the amount of tubular wall thickness and the amount of filament removed during picking. This volume of filament 104' remains constant so that during picking, the choke system 105 of this invention permits a smooth and controlled entry of the picking element into the filament 104'. The choke system of this invention then insures there will be enough filament 104' to fill the picking tubes 110' and that there will not be too much filament 104'. In the latter situation picking would produce a pushing backward of some of filament 104', and individual pieces of filament 104' would become bent over between the picking element 110' and the flapper plate 11. This would create a snarled or entangled attitude whereby the entangled filament would interfere with the flow of filament 104 through chokes 115.

Figure 9:
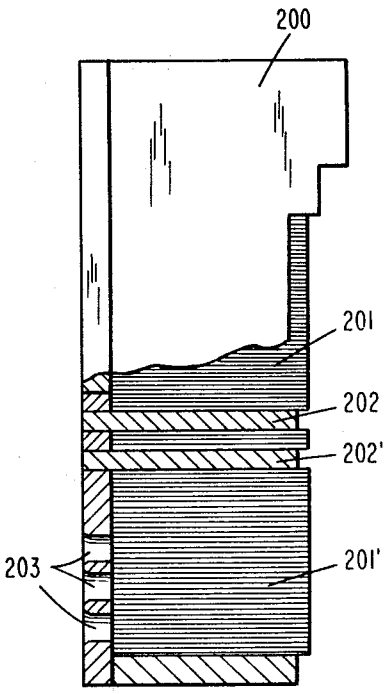
FIG. 9 is a side view of the filament stock box of FIG. 8 with a portion of the side wall removed taken along line D—D.
Figure 8:
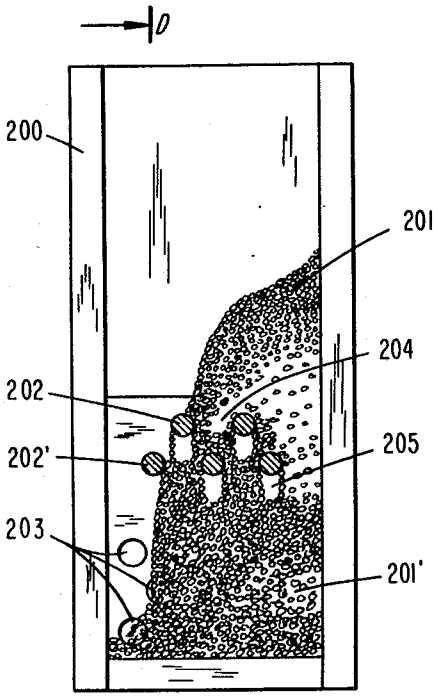
FIG. 8 is a rear view of another embodiment of the filament stock box of this invention with the rear wall and a portion of the filament removed.

The aforementioned illustration is only one of the preferred embodiments of this invention, and many types of choking means may be employed. In FIGS. 8 and 9, there is illustrated a choke system comprising a double row of choke means 202 thus creating more resistance to flow of filament 201 through the stock box. The frame 200 contains tightly packed filament 201 located above choke means 202. The filament 201' under the choke means 202 is less dense in the area of the apertures 203 and thus the volume of filament 201' is controlled during the energizing mode and only a controlled amount is allowed to pass through openings 204 between chokes 202. By having the double row of chokes 202, the filament flowing through opening 204 is impeded in its flow downward as it comes into contact with a second choke 202' which continues to slow down the rate of fall as well as the amount allowed to fall. Spacing the choke members closer to each other will have the effect of closing the opening therebetween the slowing down the rate of fall. The volume of filament in the area of the apertures then can be metered by this choke system. Chokes of this type would be preferred for level monofilament which would tend to flow very rapidly through a single choke system as described in FIGS. 1–7.

Figure 11:
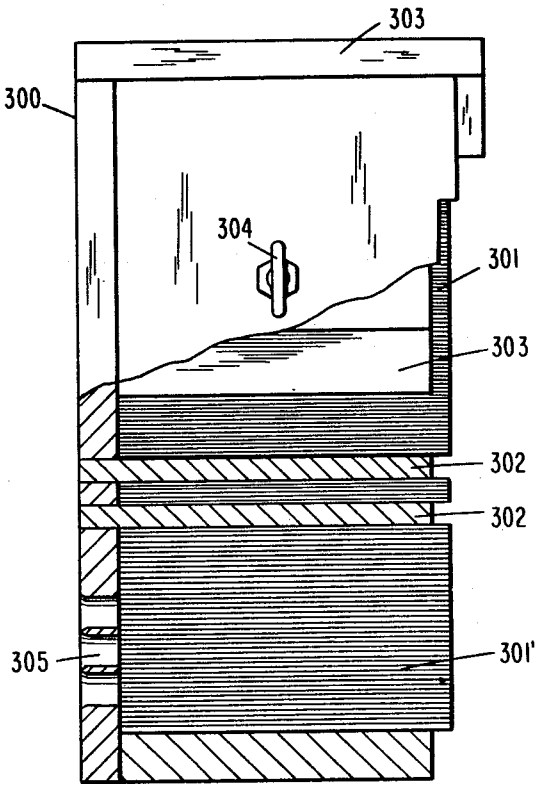
FIG. 11 is a side view of the filament stock box of FIG. 10 with a portion of the side wall removed taken along line E—E.
Figure 10:
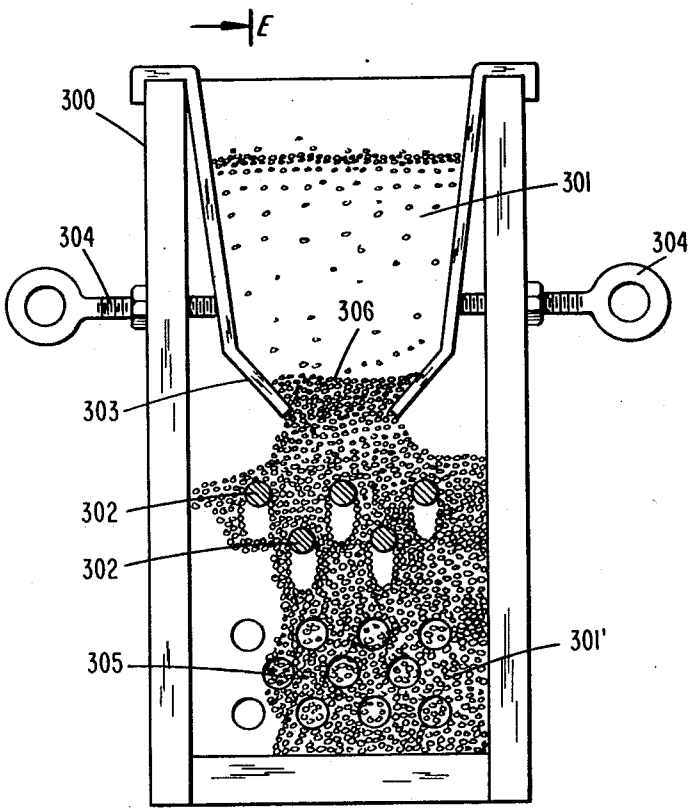
FIG. 10 is an end view of another embodiment of the filament stock box of this invention with the rear wall and a portion of the filament removed, illustrating an adjustable choke system comprising two sets of choke means.

Further means for controlling the amount of filament to be present in the aperture area of a filament stock box can be comprised of non-stationary choke means. FIGS. 10 and 11 illustrate a further embodiment for measuring filament. The filament 301 contained in stock box 300 is allowed to first flow through opening 306 which is controlled by choke means 303 which in turn can be adjusted by screws 304. As the filament flows through 306 onto choke means 302, it is kept less dense and in turn, during the energizing mode, the filament 301 is further slowed by choke 302 and continues to flow through 302 into the picking zone 305. The filament 301' is much less dense in a choke controlled stock box 300, and the choke means can be opened or closed at any time during picking.

The filament employed for brush and broom construction are in the order of 0.005" diameter up to and including 0.250" diameter. Lengths of filaments may vary from about 0.5" up to about 10.0" and may be level or crimped along their length. With these variables, this invention may vary from a single choke means whereby the flow passes through the space between the stock box side walls and a single choke up to a combination of multiple stationary and adjustable chokes. The minimum opening int he choke means is about 0.125", and the maximum distance is about 1.5 inches. The length of the opening must never be more than the length of the filament metered therethrough.

The choke means may be mounted directly on the aperture plate or on its own plate attached to the front of the frame directly above the aperture plate. Adjustable choke means may be attached to the side frames and/or partitions located within said frame.

It should be understood that by providing apertures having different configurations, circular, square, triangular, etc., different tuft cross sections may be obtained. Likewise, by arranging the apertures within the aperture face, it is also possible to pick tuft configurations having unlimited geometric arrangements.

From the foregoing it will be apparent to those skilled in the art that the instant invention provides a very simple and effective filament stock box for accomplishing the objects of the invention.

The invention in its broader aspects is not limited to the specific steps, compositions, combinations and improvements described but departures may be made therefrom within the scope of the accompanying claims without departing from the principles of the invention and without sacrificing its chief advantages.

What is claimed is:

1. A method for dispensing cut to length filaments from a filament stock box in predetermined tufts comprising the steps of:

providing a stock box including front, back and side walls and a base, the lower portion of said front wall having at least one aperture therethrough, the lower portion of said box defining a tuft picking zone and the upper portion a filament reservoir, said box adapted to contain parallel, cut to length filaments oriented parallel to the planes containing the side walls;

causing the lower portion of the back wall to vibrate against adjacent ends of filaments in said picking zone toward and away from said front wall while a tuft is withdrawn through the aperture when said filaments are contained within said box; and regulating the flow of filament from the reservoir into the picking zone when filaments are disposed within said box to maintain a lesser density of filaments in the picking zone than in the reservoir.

2. The method of claim 1 wherein the step of regulating the flow comprises providing a choke means disposed between the picking zone and the reservoir for regulating the flow of filament from the reservoir into the picking zone.

3. The method of claim 2 wherein the choke means defines an opening extending from the front wall toward the back wall of said box.

4. The method of claim 3 wherein the choke means further includes adjustment means for adjusting the width of the opening.

5. The method of claim 3 wherein the length of the opening extending between the front and back walls is less than the length of the filament passing therethrough.

6. The method of claim 2 wherein the step of providing a choke means includes providing at least one rod like bar member extending from the front and toward the back wall of said box.

7. The method of claim 2 wherein the step of regulating further comprises providing a choke means defining an elongated opening extending from the front wall and toward the back wall and at least one rod like bar extending parallel to said opening.

8. The method of claim 2 wherein the step of providing the choke means comprises providing a plurality of rod like bars mutually spaced and disposed in parallel planes extending from the front wall toward the back wall of said box above the aperture.

9. The method of claim 8 further comprising providing said rod like bars disposed in two rows with the longitudinal axis of each bar contained in a different parallel vertical plane.

10. The method of claim 8 wherein said rods are disposed in an upper row and a lower row with the longitudinal axis of each lower bar being contained in a vertical plane common to the plane containing the longitudinal axis of an upper bar.

11. The method of claim 8 wherein said rods are disposed in three rows.

12. The method of claim 2 wherein the step of providing the choke means comprises providing in combination a plurality of openings extending from the front wall toward the back wall, said openings being contained in parallel vertical planes and a plurality of rod like bars disposed in parallel extending from the front wall toward the back wall.

13. The method of claim 12 wherein said rods are disposed below said openings but above the aperture in the front wall.

14. The method of claim 13 wherein said rods are disposed in a single parallel row.

15. The method of claim 13 wherein said rods are disposed in a plurality of rows.

* * * * *